US007143516B2

(12) United States Patent
Sterios

(10) Patent No.: US 7,143,516 B2
(45) Date of Patent: Dec. 5, 2006

(54) PENCIL SHARPENER CAP

(76) Inventor: Leanna Sterios, 1016 S. Masselin Ave., #3, Los Angeles, CA (US) 90019

( * ) Notice: Subject to any disclaimer, the term of this patent is extended or adjusted under 35 U.S.C. 154(b) by 74 days.

(21) Appl. No.: 10/247,183

(22) Filed: Sep. 18, 2002

(65) Prior Publication Data

US 2004/0049929 A1 Mar. 18, 2004

(51) Int. Cl.
*B43K 9/00* (2006.01)

(52) U.S. Cl. ..... 30/454; 401/50

(58) Field of Classification Search ..... 30/453–455, 30/461; 401/50, 51; D19/73
See application file for complete search history.

(56) References Cited

U.S. PATENT DOCUMENTS

| | | | | | |
|---|---|---|---|---|---|
| 1,306,903 | A * | 6/1919 | Imaizumi | 30/452 |
| 1,832,272 | A * | 11/1931 | Zimdars et al. | 401/51 |
| 1,958,461 | A * | 5/1934 | Barclay | 30/457 |
| 2,198,384 | A * | 4/1940 | Hammer-Purgstall | 401/51 |
| 2,333,714 | A * | 11/1943 | Fletcher | 30/457 |
| 2,514,761 | A * | 7/1950 | Egil | 144/28.11 |
| 2,757,638 | A * | 8/1956 | Goldstein | 144/28.11 |
| 2,769,428 | A * | 11/1956 | Onanian | 144/28.4 |
| 3,232,275 | A * | 2/1966 | Ziegler et al. | 401/51 |
| 3,288,113 | A * | 11/1966 | Gabler | 401/50 |
| 4,269,523 | A * | 5/1981 | Kay | 401/51 |
| 5,599,123 | A * | 2/1997 | Still | 401/52 |
| 5,647,138 | A * | 7/1997 | Tang et al. | 30/454 |
| 6,132,476 | A * | 10/2000 | Lunsford et al. | 8/531 |
| 6,286,218 | B1 * | 9/2001 | Luttgens | 30/454 |
| 6,427,343 | B1 * | 8/2002 | Chang | 30/454 |
| 2001/0016989 | A1 * | 8/2001 | Luttgens | 30/454 |
| 2001/0052188 | A1 * | 12/2001 | Luttgens | 30/454 |
| 2005/0044730 | A1 * | 3/2005 | Fischer | 30/454 |

FOREIGN PATENT DOCUMENTS

| | | | |
|---|---|---|---|
| JP | 6-199093 | * | 7/1994 |

* cited by examiner

*Primary Examiner*—Kenneth E. Peterson
(74) *Attorney, Agent, or Firm*—Rutan & Tucker, LLP

(57) ABSTRACT

The present invention involves a pencil sharpener that is housed in a pencil cap, having a variable-sized shavings reservoir. The shavings reservoir can be expanded by moving at least one of an internal wall, an external wall, and the sharpener. Contemplated caps comprise any suitable dimension, but preferably have a length that is at least 50%, or at least 75%, that of a corresponding full-length pencil.

11 Claims, 2 Drawing Sheets

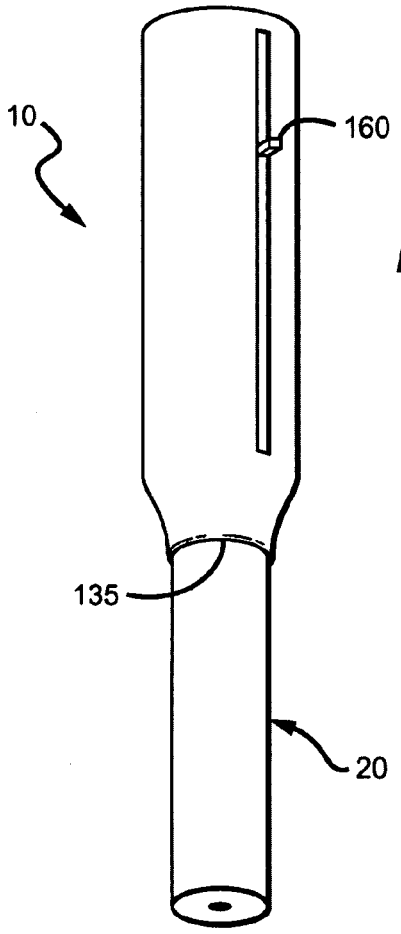
FIG. 3
FIG. 4
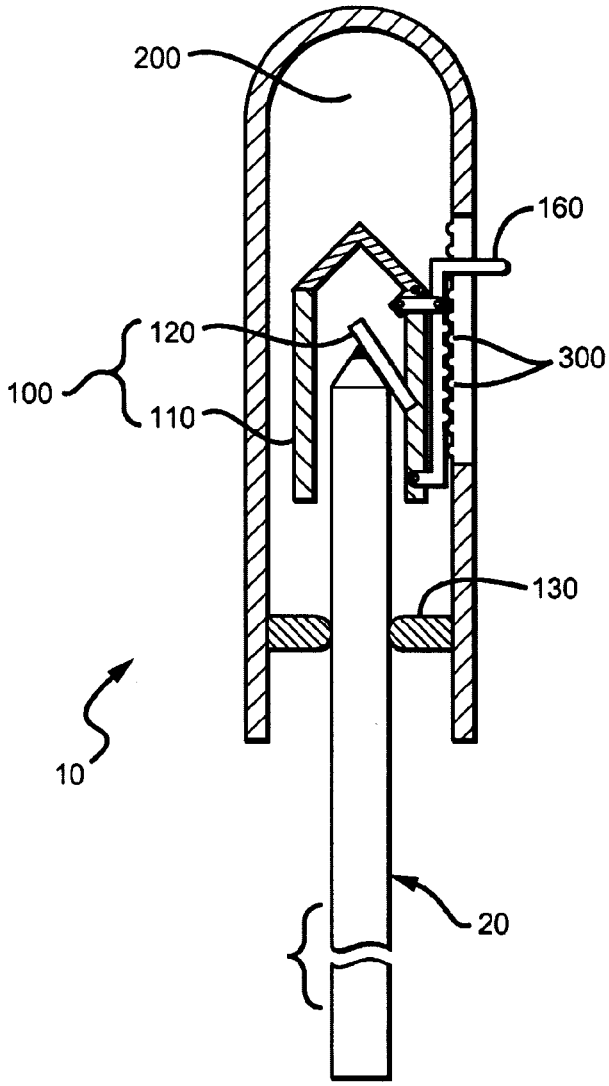

PENCIL SHARPENER CAP

FIELD OF THE INVENTION

The field of the invention is pencil sharpeners.

BACKGROUND OF THE INVENTION

Pencils have been used for many years and are widely distributed. Generally, there are two common types of pencils: wooden pencils and mechanical pencils.

Wooden pencils suffer from several disadvantages. One disadvantage is that wooden pencils often become blunt upon use. Another disadvantage of wooden pencils is that the lead breaks easily, during both use and transport. Still another disadvantage is that handling wooden pencils is often messy because the lead is usually exposed and can rub off on clothing, hands, and other items. Furthermore, if the lead breaks, disposing of the broken piece of lead becomes a nuisance. This is even more problematic when using cosmetic pencils because the "lead" is so soft and breaks easily.

One method of overcoming at least some of those disadvantages is to carry several sharpened wooden pencils in order to account for dulling or breaking of the lead. However, carrying several wooden pencils is extremely inconvenient, especially because it is difficult to estimate how many pencils will be needed.

Mechanical pencils are a partial substitute to wooden pencils. Mechanical pencils eliminate the need to sharpen pencils because the lead is so small that it never needs sharpening. However, mechanical pencils also suffer from several disadvantages. For example, mechanical pencils are not especially useful to artists in shading their drawings.

Another method of overcoming at least some of those disadvantages is to keep a pencil sharpener handy. However, that solution is also problematic for several reasons. First, one must remember to always keep a pencil sharpener handy. Second, it is inconvenient to have to carry both a pencil and a sharpener, especially when space is limited. Furthermore, sharpening a pencil can be messy, especially if the sharpener does not contain a cavity to catch the shavings.

Some manufacturers have introduced pencils with attached sharpeners to try to overcome some of those disadvantages. However, those pencil-attached pencil sharpeners still suffer from disadvantages. For example, some pencil-attached pencil sharpeners do not contain a cavity to catch shavings, which would make sharpening the pencil messy and time consuming. Furthermore, in pencil-attached pencil sharpeners, the length of the pencil together with the cap becomes shorter as the pencil is sharpened. Carrying longer pencils is difficult, especially cosmetic pencils that are typically carried in a purse or other small compartment.

Thus, there is still a need for an improved pencil-attached pencil sharpener.

SUMMARY OF THE INVENTION

The present invention involves a pencil sharpener that is housed in a pencil cap having a variable-sized shavings reservoir.

In preferred embodiments the shavings reservoir is expanded by moving the sharpener. The pencil sharpener cap can also include a retention mechanism that removably couples the pencil sharpener cap to a corresponding pencil, such as a snap-fit mechanism or a friction or compression collar.

Contemplated caps can have any suitable dimensions, but preferably have a length that is at least 50%, or at least 75%, that of a corresponding full-length pencil.

Various objects, features, aspects, and advantages of the present invention will become more apparent from the following detailed description of preferred embodiments of the invention.

BRIEF DESCRIPTION OF THE DRAWING

FIG. 3 is a perspective front view of the pencil sharpener cap coupled to a pencil.

FIG. 4 is a vertical cross-section of an alternative embodiment of the pencil sharpener cap and pencil.

DETAILED DESCRIPTION

Figure 1:
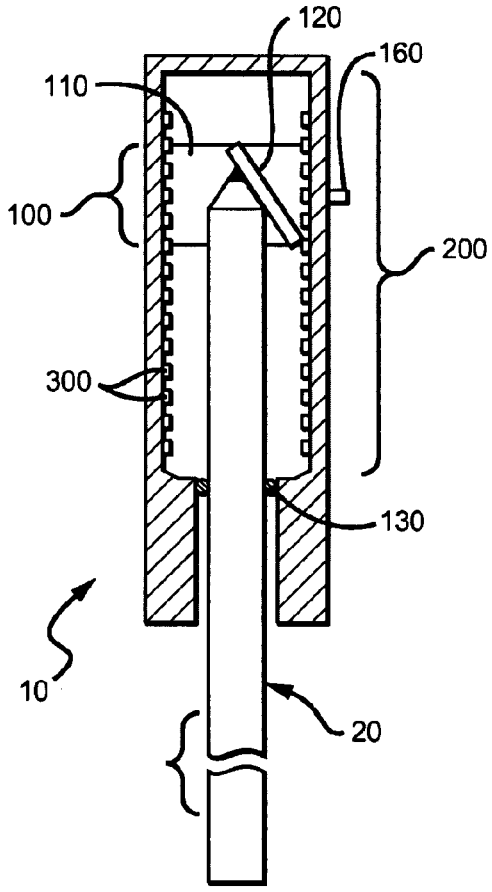
FIG. 1 is a vertical cross-section of the pencil sharpener cap coupled to a pencil.

FIG. 1 generally comprises a pencil sharpener cap 10 that removably receives a pencil 20. The pencil sharpener cap 10 generally comprises a sharpener 100, a variable-size shavings reservoir 200, and a mechanism 300 for changing the size of the shavings reservoir 200.

Pencils 20 generally have a relatively hard covering and a relatively soft center. The covering may comprise any plastic, wood, paper, or polymer that sufficiently protects the soft center from breaking or smearing. The "center" of a pencil 20 is sometimes referred to as "lead" although even in drawing pencils, the "lead" is a misnomer and refers to graphite. As used herein, the term "center" can comprise any material or compound including wax, lead, graphite, plastic polymer, drugs, pharmaceuticals, cosmetics, etc. that can be formulated to be delivered through a pencil. Pencils 20 may be any standard or non-standard sized pencil 20, including narrow to wide diameter pencils. It is especially contemplated that pencils 20 include cosmetic pencils, including eye pencils, lip pencils, and other makeup pencils.

The sharpener 100 generally comprises a housing 110 and a cutter 120. The housing 110 may comprise any durable material that is capable of holding pencil 20 in place during sharpening without squashing or damaging the pencil. Thus, contemplated materials comprising the housing 110 include plastic, and possibly hard rubber. In preferred embodiments, the housing 110 is sized and dimensioned to create a desired shape to fit narrow or wide diameter pencils.

Cutter 120 is contemplated to comprise any durable, rust-proof material, including stainless steel, aluminum, metal alloy, or hard plastic material or polymer. Positioning of the cutter 120 likely affects the sharpness/bluntness of the soft center after sharpening. The cutter 120 is typically positioned at least 45 degrees from the normal angle to create a very sharp tip, and less than 20 degrees from the normal angle to create a blunt tip. It is contemplated that the cutter is positioned so as to minimize jamming of the soft center of a pencil 20.

Cap 10 has a retention mechanism that removably couples the cap 10 to a corresponding pencil 20. FIG. 1 depicts a retention mechanism that is a snap fit mechanism, with a retention ring 130 placed near the open end of the cap 10 to provide a gripping and retention mechanism between the cap 10 and the corresponding pencil 20. The retention ring 130 works in a fashion similar to that of many common plastic pens and their corresponding caps. Other contemplated retention mechanisms include friction or compression collar mechanisms 135, as depicted in FIG. 3. When a friction or compression collar mechanism is used, the cap 10 is pressed onto the pencil 20 until the cap 10 is relatively securely in place.

Figure 2:
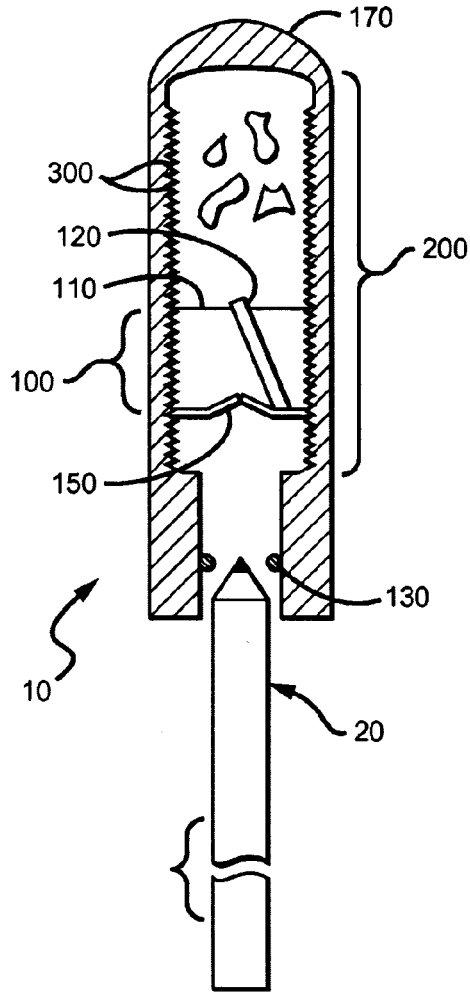
FIG. 2 is a vertical cross-section of the pencil sharpener cap and a corresponding pencil.

Further contemplated embodiments include kits comprising a pencil 20 and a corresponding pencil sharpener cap 10 that are sized and dimensioned so that when the cap covers the pencil, the length of the cap 10 together with the pencil 20 remain approximately a constant size as the pencil is used and sharpened. This is depicted in FIGS. 1 and 2. Thus, when the pencil 20 is full-length, a larger portion of the pencil 20 will fit inside the cap 10, and as the pencil 20 becomes smaller, less of the pencil 20 fits inside the cap 10. The cap 10 preferably has a length at least 50% or even 75% that of the length of the corresponding pencil 20. Viewed from another perspective, when a full-length pencil 20 is stored within the cap 10, the lumen of the cap 10 may receive at least 50%, or 75% that of the length of the pencil 20.

In FIG. 2, biased flaps 150 are used in the pencil sharpener cap 10 to prevent shavings or lead from the cutter 220 or the reservoir 300 from falling out. The biased flaps 150 are preferably positioned near or on the sharpener 100 so that when a pencil 20 is inserted into the housing, the biased flaps 150 open to allow insertion of the pencil 20. Furthermore, when the pencil 20 is pulled out, the biased flaps 150 remain in a closed position, which tends to prevent shavings and other debris from falling out. It is especially preferred that the biased flaps 150 are positioned on the sharpener at a point near where the pencil 20 is inserted into the sharpener 100 so as to catch and prevent all the shavings and other debris from falling out of the cap.

The shavings reservoir 200 is the space between the closed end of the cap 10 and the sharpener 100. The shavings reservoir 200 is capable of holding at least some of the shavings from the corresponding pencil 20. In preferred embodiments, the shavings reservoir 200 holds all the shavings from a corresponding pencil 20. Thus, the shavings reservoir 200 may be sized and dimensioned to hold a volume of between 15 and 100 cc, and more preferably between 30 and 60 cc. The key is that the maximum size of the shavings reservoir 200 should be capable of holding all the shavings from one pencil 20.

It is further contemplated that at least one of the interior wall, exterior wall, and sharpener 100 is moved in order to increase or decrease the size of the shavings reservoir 200. The internal wall may comprise a portion of the sharpener 100. The external wall may be telescopically coupled to the sharpener 100. The mechanism through which the shavings reservoir 200 moves is discussed in detail below.

The cap 10 is probably injection molded and most likely has a substantially uniform wall thickness so that the shape of the reservoir 200 is likely approximately the same shape as the outer portion of the cap 10. The outer portion of the cap 10 may comprise any suitable shape including substantially tubular, substantially rectangular, or any other shape that is easy to handle and transport such as in a purse, pocket, or briefcase. In preferred embodiments, the cap 10 is substantially tubular with a tapered end.

A notch-type mechanism may be used to move the shavings reservoir 200. A notch-type mechanism functions in a manner that allows one to manually slide the sharpener 100 away from the opening of the cap 10 to decrease the size of the shavings reservoir 200 or down the cap 10 to increase the size of the shavings reservoir 200. FIGS. 1 and 3 depict a notch-type mechanism where a tab 160 is coupled to the sharpener 100 and extends to the periphery of the cap 10 to allow one to manually slide the notch up and down the cap 10 in order to move the sharpener 100.

In FIG. 2, the retention mechanism 300 is a screw type mechanism. The sharpener 100 is typically placed on grooves so that the sharpener is carried along the screws to increase or decrease the size of the shavings reservoir 200. The screws can be turned by any known mechanism, including a dial, rotary actuator 170, or other type of handle. FIG. 2 depicts a rotary actuator located at the tapered end of the cap 10. Another less preferred embodiment includes coupling the rotation of the pencil during sharpening to the movement of the sharpener so that as the pencil is sharpened, the sharpener moves toward the open end of the cap. The twisting of the sharpener 100 may or may not be coupled to the twisting of the pencil 20 during sharpening.

Thus, specific embodiments and applications have been disclosed of pencil sharpener caps. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A pencil sharpener cap having a substantially fixed outer shape, a shavings reservoir, a sharpener coupled to an outer barrel via various discreet stops disposed along a longitudinal direction on the outer barrel, wherein a user-operable actuator is positioned on an outside surface of the outer barrel, wherein the movement of the user-operable actuator varies the size of the reservoir in the absence of the pencil by moving the sharpener alone the various discreet stops in the longitudinal direction, and wherein the sharpener is capable of sharpening the pencil while the sharpener is lockingly positioned in any of the various discreet stops.

2. The pencil sharpener cap of claim 1, wherein the pencil sharpener cap has a substantially tubular body.

3. The pencil sharpener cap of claim 1, wherein the pencil sharpener cap comprises a retention mechanism that removably couples the pencil sharpener cap to a pencil.

4. The pencil sharpener cap of claim 3, wherein the retention mechanism comprises a friction or a compression collar.

5. The pencil sharpener cap of claim 3, wherein a total length is defined as the length of the pencil together with the cap when the pencil is being sharpened by the sharpener, wherein the total length remains approximately the same for the life of the pencil.

6. The cap of claim 1 wherein the user-operable actuator is a tab.

7. A pencil sharpener cap having a shavings reservoir inside a substantially fixed size outer barrel, and a cutter member that moves along the barrel at various discreet stops along a longitudinal direction to vary the size of the reservoir, wherein the cutter member is coupled to the barrel via a movement mechanism having a plurality of recess structures defining the various discreet stops positioned on an inside surface of the outer barrel, a user-operable actuator coupled to the movement mechanism, wherein the user-operable actuator is positioned on an outside surface of the outer barrel, wherein the movement of the user-operable actuator varies the size of the reservoir in the absence of the pencil, and wherein the sharpener is capable of sharpening the pencil while the sharpener remains lockingly positioned in any of the various discreet stops.

8. The pencil sharpener cap of claim 7, further comprising a retention mechanism that removably couples the pencil sharpener cap to a pencil.

9. The pencil sharpener cap of claim 8, wherein the retention mechanism comprises a friction or a compression collar.

10. The pencil sharpener cap of claim 7, wherein the user-operable actuator is disposed to move in a slot along the outside of the barrel.

11. The pencil sharpener cap of claim 7, wherein the shavings reservoir that varies in size by at least 25% without disassembling the pencil sharpener.

* * * * *